US011478095B2

(12) United States Patent
Gauss

(10) Patent No.: US 11,478,095 B2
(45) Date of Patent: Oct. 25, 2022

(54) OFF TABLE HOLDER FOR STEMMED DRINKING VESSELS AND UTENSILS

(71) Applicant: GSI Outdoors, Inc., Spokane, WA (US)

(72) Inventor: Kurt F. Gauss, Spokane, WA (US)

(73) Assignee: GSI Outdoors LLC, Spokane Valley, WA (US)

( * ) Notice: Subject to any disclaimer, the term of this patent is extended or adjusted under 35 U.S.C. 154(b) by 0 days.

(21) Appl. No.: 17/330,025

(22) Filed: May 25, 2021

(65) Prior Publication Data

US 2022/0061567 A1 Mar. 3, 2022

Related U.S. Application Data

(60) Provisional application No. 63/031,202, filed on May 28, 2020.

(51) Int. Cl.
*A47G 23/00* (2006.01)
*A47G 23/02* (2006.01)

(52) U.S. Cl.
CPC ..... *A47G 23/0225* (2013.01)

(58) Field of Classification Search
None
See application file for complete search history.

(56) References Cited

U.S. PATENT DOCUMENTS

D203,055 S * 11/1965 Robinson ..... D7/620
4,961,555 A * 10/1990 Egan, Jr. ..... A47G 23/0225 248/314
5,586,804 A * 12/1996 Burroughs ..... A47C 7/624 297/188.21
D449,206 S * 10/2001 DuBow ..... D7/708.1
6,361,105 B1 * 3/2002 Turner ..... A47C 7/62 297/16.2
9,955,810 B1 * 5/2018 Diederich ..... A47G 23/0225
2015/0353200 A1 * 12/2015 Thomaschewski .... B64D 11/06 297/188.21
2016/0029803 A1 * 2/2016 Haenga ..... A47B 13/16 248/205.2
2019/0307253 A1 * 10/2019 Pendleton, Jr. ..... A47C 7/624

* cited by examiner

*Primary Examiner* — Steven M Marsh
(74) *Attorney, Agent, or Firm* — Randall Danskin P.S.

(57) ABSTRACT

An off table holder for a stemmed drinking vessel and/or utensil that is movably secured to a bottom surface of a supporting table.

11 Claims, 12 Drawing Sheets

OFF TABLE HOLDER FOR STEMMED DRINKING VESSELS AND UTENSILS

CROSS REFERENCE TO RELATED APPLICATIONS

This U.S. Non-Provisional Patent Application claims the benefit of earlier filed U.S. Provisional Patent Application No. 63/031,202 which was filed on 28 May 2020 and which is titled "Off Table Holder for Stemmed Drinking Vessels and Utensils". The aforementioned and identified U.S. Provisional Patent Application is expressly incorporated herein by this reference in its entirety. Pursuant to USPTO rules, this claim of priority is also set forth in the Application Data Sheet (ADS) filed contemporaneously herewith.

The inventorship of the earlier filed U.S. Provisional Patent Application and this Non-Provisional Patent application is the same.

TECHNICAL FIELD

This invention relates to holders for drink containers and utensils, and more specifically, this invention relates to an off table holder for stemmed drinking vessels and utensils.

BACKGROUND OF THE INVENTION

With the great increase in outdoor entertaining, picnicking, concerts, hiking, camping and the like, where table space on which to place food, drinks, drinking vessels and cups and utensils is at a premium, and where drink containers (particularly stemmed drinking vessels) tend to fall over, there is a growing need for a device to adequately hold a glass in an upright position, and more specifically, hold a stemmed drinking vessel in an upright orientation, as well as a holder for utensils.

The invention herein provides a table supported body. The body is movable relative to a peripheral edge of the supporting table and the body defines an open through hole holder for placement and retention of drinking vessels and/or utensils. The body is movable between a first retracted position adjacent to and completely under the supporting table, and a second extended position wherein a portion of the body defining the open through hole holder extends outwardly of the adjacent peripheral edge of the supporting table so that a stemmed drinking vessel (which may be, but is not limited to a wine glass or champagne flute) and/or utensils may be removably placed within the open through hole holder, and the stemmed drinking vessel is retained in an upright orientation, and/or the utensil is supported off the table and off an underlying supporting surface, such as, but not limited to the ground surface.

SUMMARY OF THE INVENTION

A first aspect of the present invention is an off table holder for a stemmed drinking vessel and/or utensil that is movably secured to a bottom surface of a supporting table, the holder comprising: a body having a first end portion, a spaced apart second end portion, a first lateral side, a second lateral side, a top and a bottom; a through hole defined in the body spacedly adjacent the first end portion for carrying a fastener; the fastener has an elongate cylindrical body and a radially enlarged head portion at one end of the elongate cylindrical body, and the fastener elongate cylindrical body extends axially through the through hole defined in the body spacedly adjacent the first end portion and engages with the bottom surface of the supporting table, spacedly adjacent inwardly a peripheral edge of the supporting table, and the radially enlarged head portion of the fastener has a diameter that will not pass axially through the through hole; an open through hole having an access slot is defined in the body spacedly adjacent the second end portion; and the body is movable between a first position and a second position relative to the peripheral edge of the supporting table and relative to the fastener extending through the through hole defined in the first end portion of the body.

A further aspect of the instant invention is a holder for a stemmed drinking vessel and/or utensil and wherein the body is tapered so that a width dimension of the first end portion is smaller than a width dimension of the second end portion.

A further aspect of the present invention is a holder for a stemmed drinking vessel and/or utensil and wherein the body is rectilinear.

A further aspect of the present invention is holder for a stemmed drinking vessel and/or utensil and wherein the fastener extending through the through hole defined in the first end portion functions as a vertical axle, and the body rotates thereabout between the first retracted position and the second extended position.

A further aspect of the present invention is holder for a stemmed drinking vessel and/or utensil and further comprises: plural spacedly arrayed through holes defined in the first end portion of the body, and each of the plural through holes is an elongated hole, and each of the elongated holes is parallel to the others of the plural elongated holes; and a fastener extends through each of the plural elongated holes; and the body slidably moves relative to the peripheral edge of the supporting table along the plural fasteners extending through the plural elongated holes.

These and other aspects of the invention will become more clear from the disclosure that follows.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
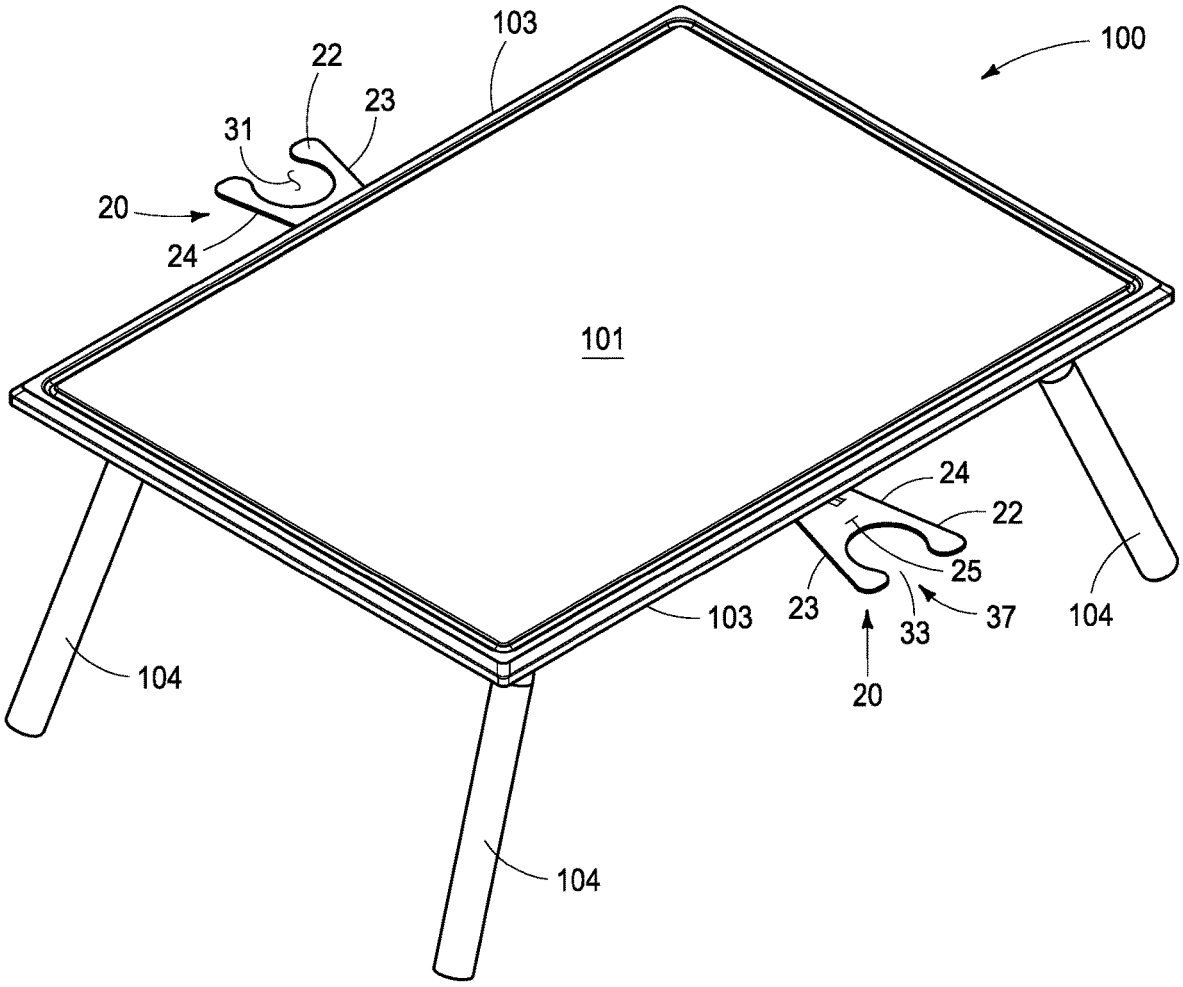
FIG. 1 is a perspective top, end and lateral side view of a supporting table, with supporting legs extended, with the inventive holder for a stemmed drinking vessel and/or utensil in a second position, extending outwardly from under each of the opposing lateral sides of the supporting table.
Figure 2:
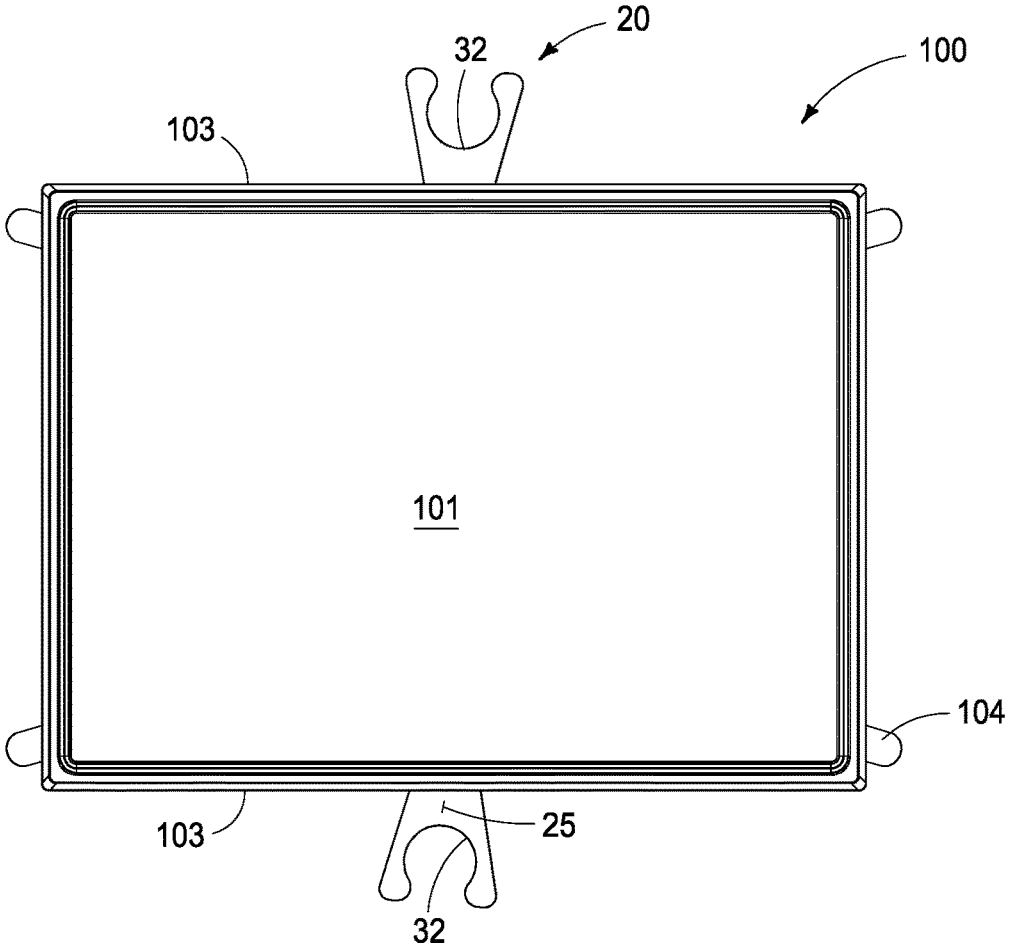
FIG. 2 is a top plan view thereof.
Figure 3:
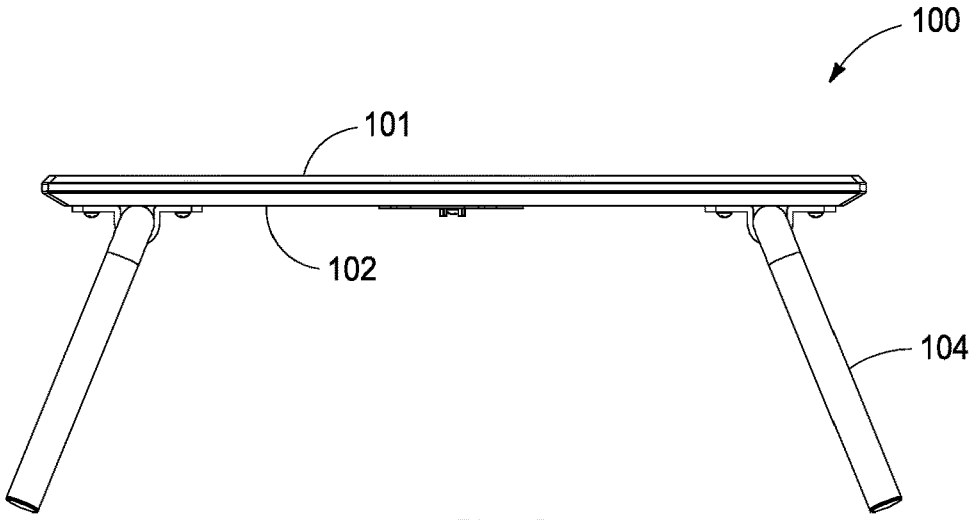
FIG. 3 is an orthographic lateral side view thereof, both lateral sides being the same.
Figure 4:
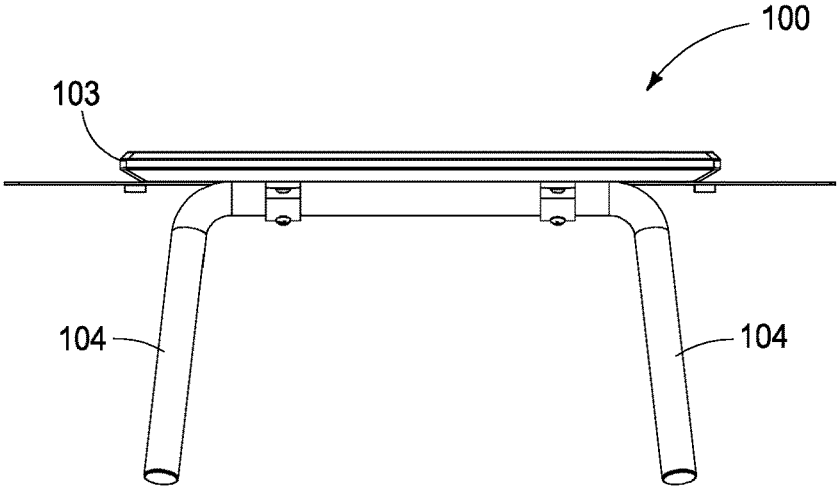
FIG. 4 is an orthographic end view thereof, both ends being the same.

This disclosure of the invention is submitted in furtherance of the Constitutional purposes of the U.S. Patent Laws "to promote the progress of science and useful arts" (Article 1, Section 8).

A holder for a stemmed drinking vessel and/or utensil generally provides a body 20 having a first end portion 21, a second end portion 22, a first lateral side 23, a second lateral side 24, a top 25 and a bottom 26.

As shown in FIGS. 5, 10, 15, 20 and 21, the body 20 is movably secured to a bottom surface 102 of a supporting table 100 spacedly adjacent a peripheral edge 103 of the supporting table 100. The supporting table 100 has plural supporting legs 104 that are movable relative to the bottom surface 102 of the supporting table 100, and when the supporting legs 104 are in an extended/use position (FIGS. 1, 11) the bottom surface 102 of the supporting table 100 is spacedly above an underlying supporting surface (not shown), which may be, but is not limited to, the ground surface which may be other than level and may be grass or other soft uneven surface. The supporting legs 104 may be movable by a variety of means and in a variety of directions, and may likewise move individually or in pairs. Movement of the supporting legs 104 is not limiting herein.

When the supporting legs 104 are in a retracted/transport position (FIGS. 10, 20) the dimensions of the supporting table 100 are reduced which facilitates ease of transport and storage. Although the accompanying drawings show a supporting table 100 having a rectilinear configuration and four supporting legs 104, other types, shapes, configurations of supporting tables 100, and having other types of supporting legs 104 are contemplated herein and the disclosed invention is equally applicable therewith.

Figure 5:
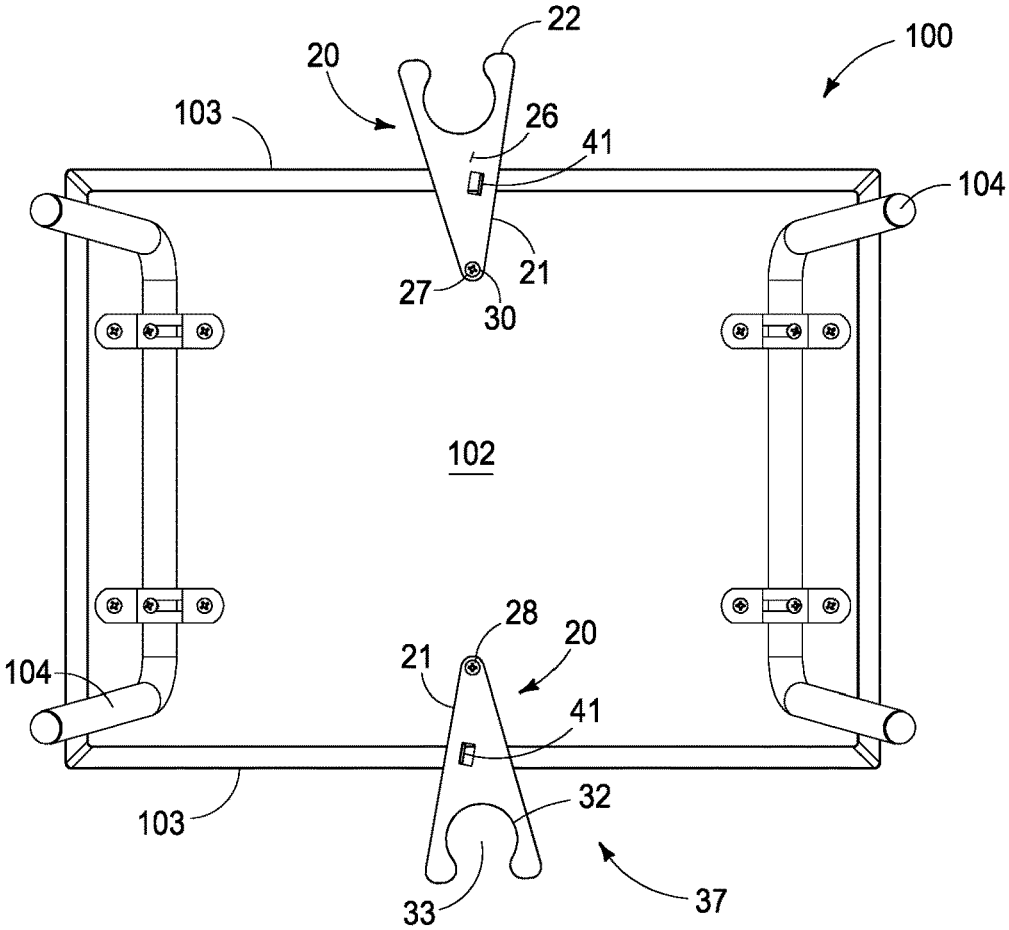
FIG. 5 is a bottom plan view thereof.
Figure 6:
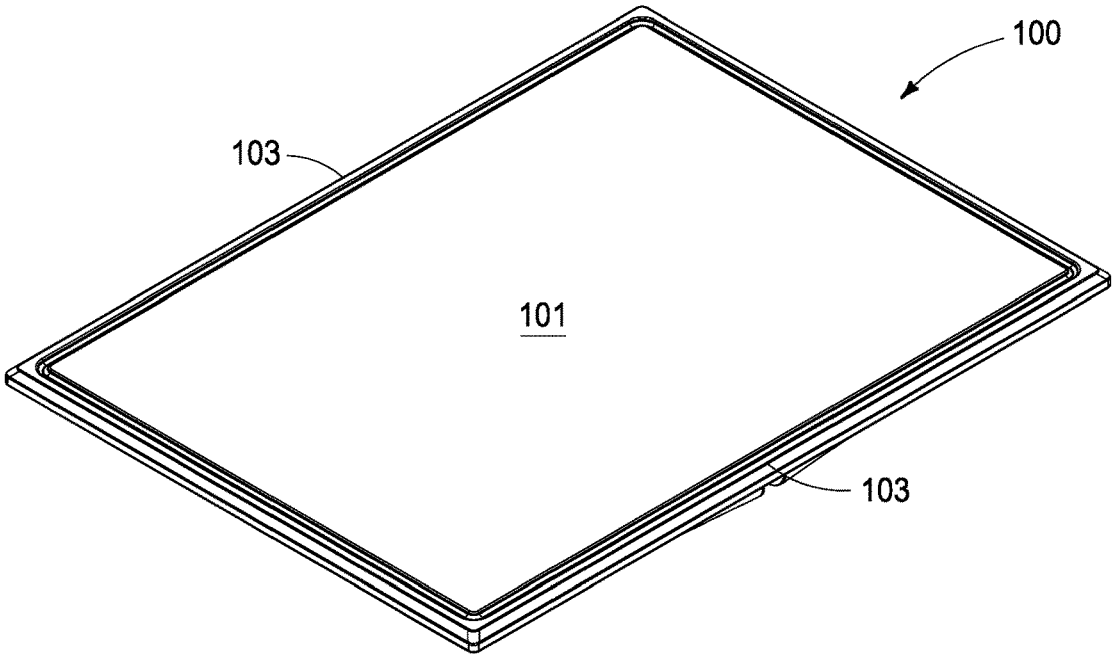
FIG. 6 is a perspective top, end and lateral side view of a supporting table, with the supporting legs retracted to a transport orientation, with the holders for a stemmed drinking vessel and/or utensil both in a first retracted position.
Figure 7:
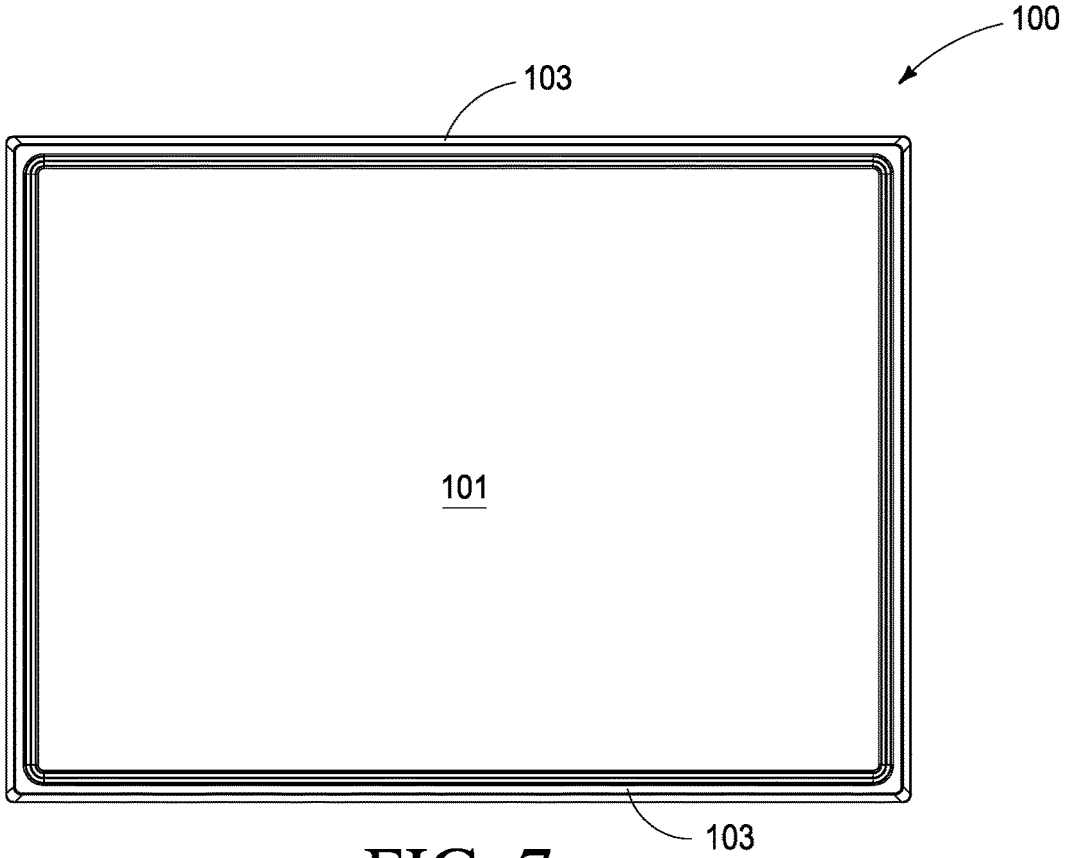
FIG. 7 is a top plan view thereof.
Figure 8:
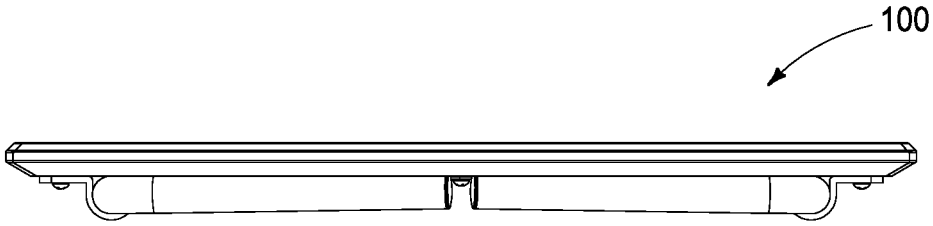
FIG. 8 is an orthographic lateral side view thereof, both lateral sides being the same.
Figure 9:
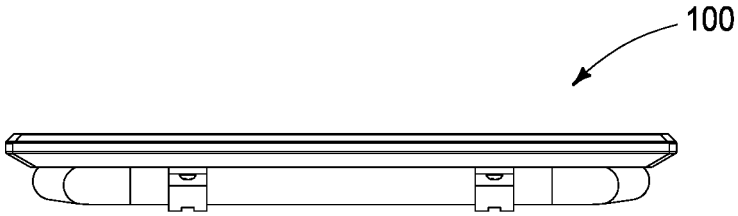
FIG. 9 is an orthographic end view thereof, both ends being the same.
Figure 10:
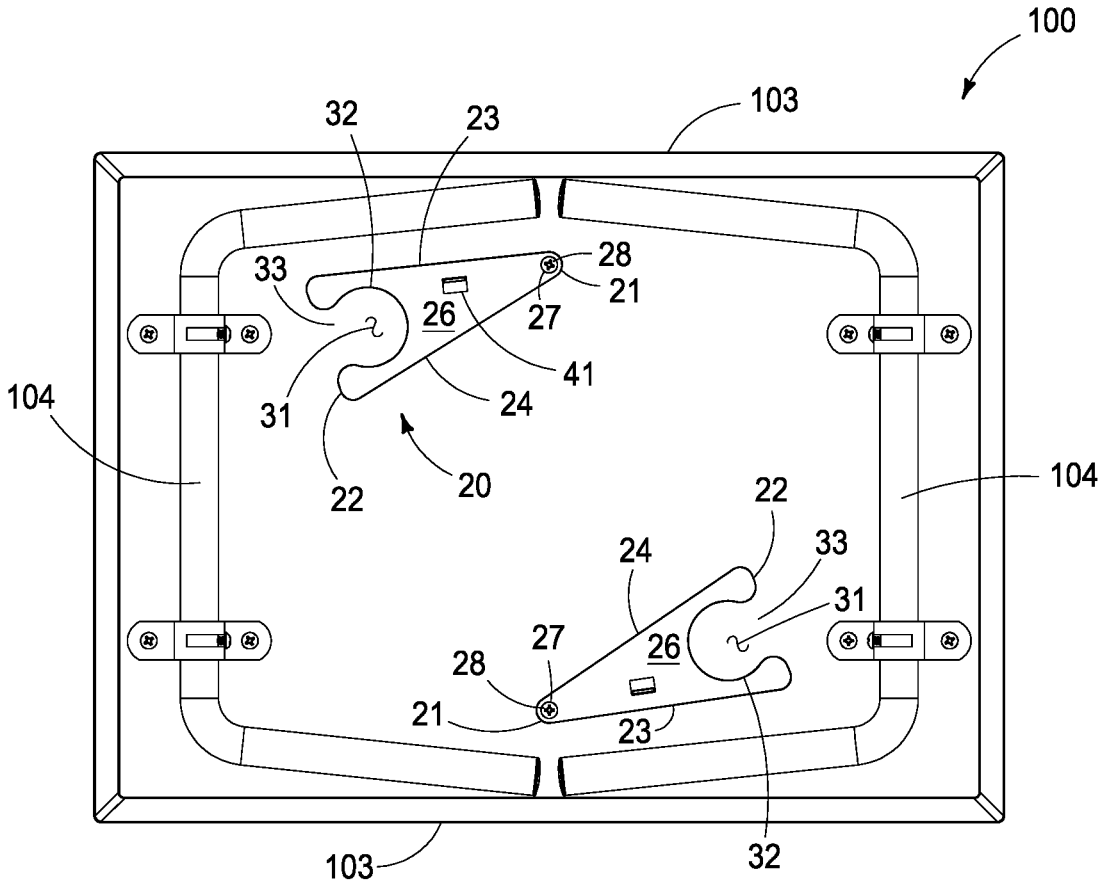
FIG. 10 is a bottom plan view thereof.
Figure 15:
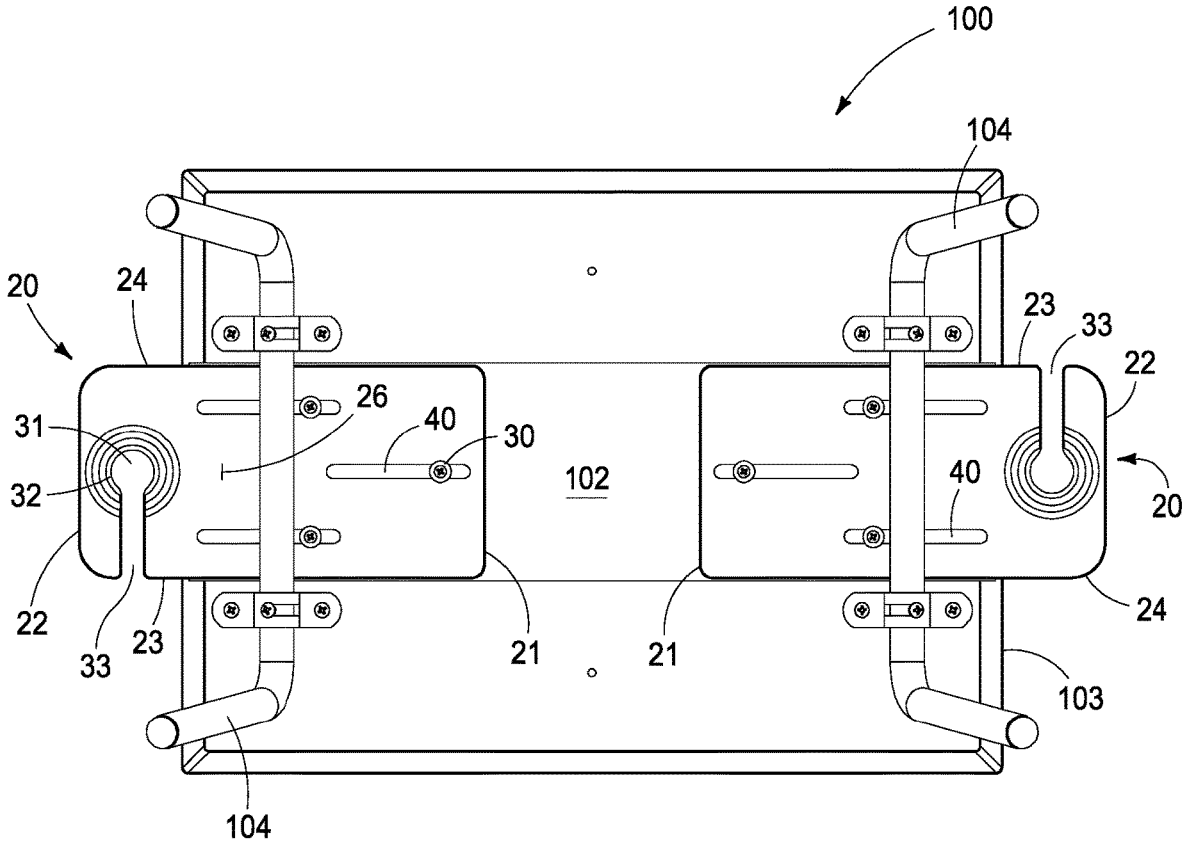
FIG. 15 is a bottom plan view thereof.
Figure 16:
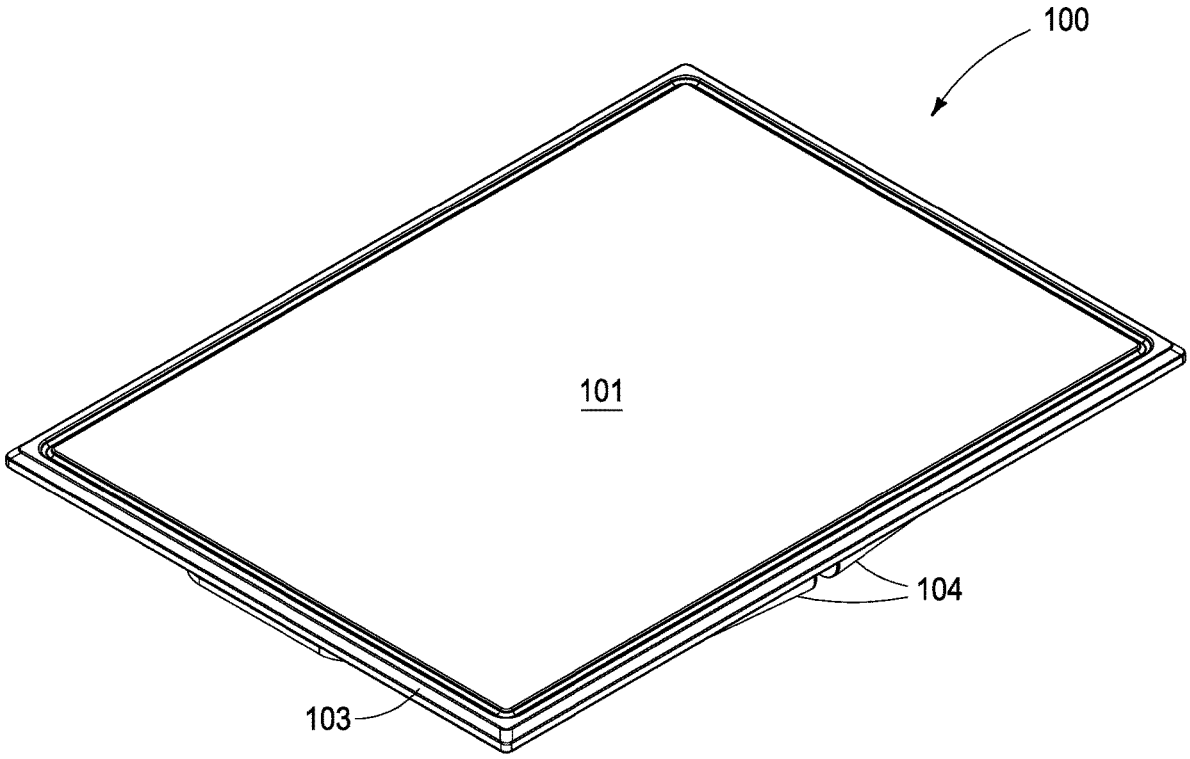
FIG. 16 is a perspective top, end and lateral side view of a supporting table, with the supporting legs retracted to a transport orientation, with the holders for a stemmed drinking vessel and/or utensil both in the first retracted position.
Figure 17:
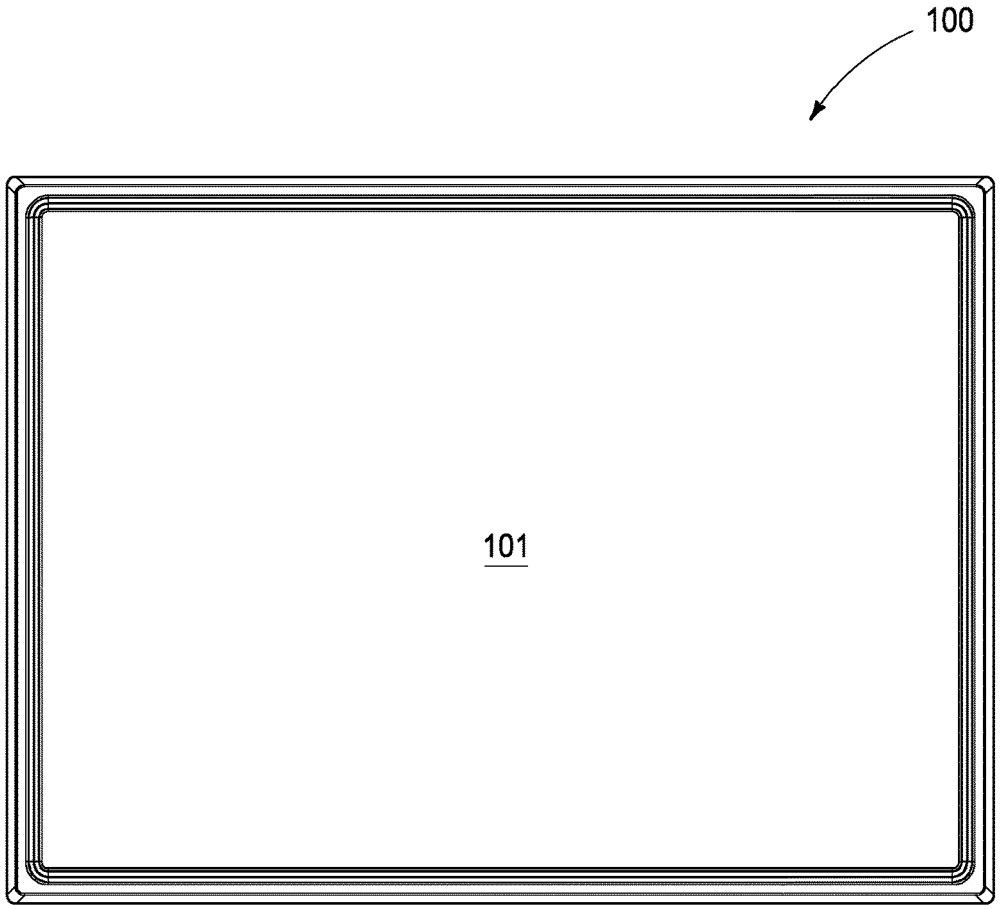
FIG. 17 is a top plan view thereof.
Figure 18:
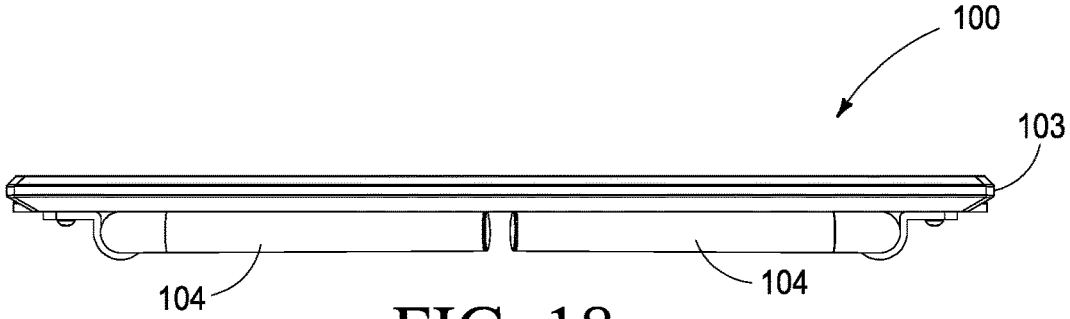
FIG. 18 is an orthographic lateral side view thereof, both lateral sides being the same.
Figure 19:
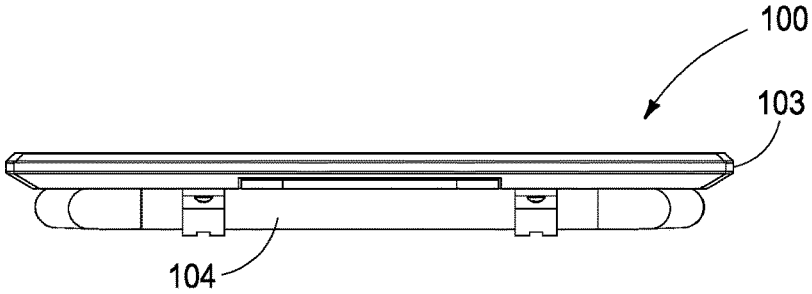
FIG. 19 is an orthographic end view thereof, both ends being the same.
Figure 20:
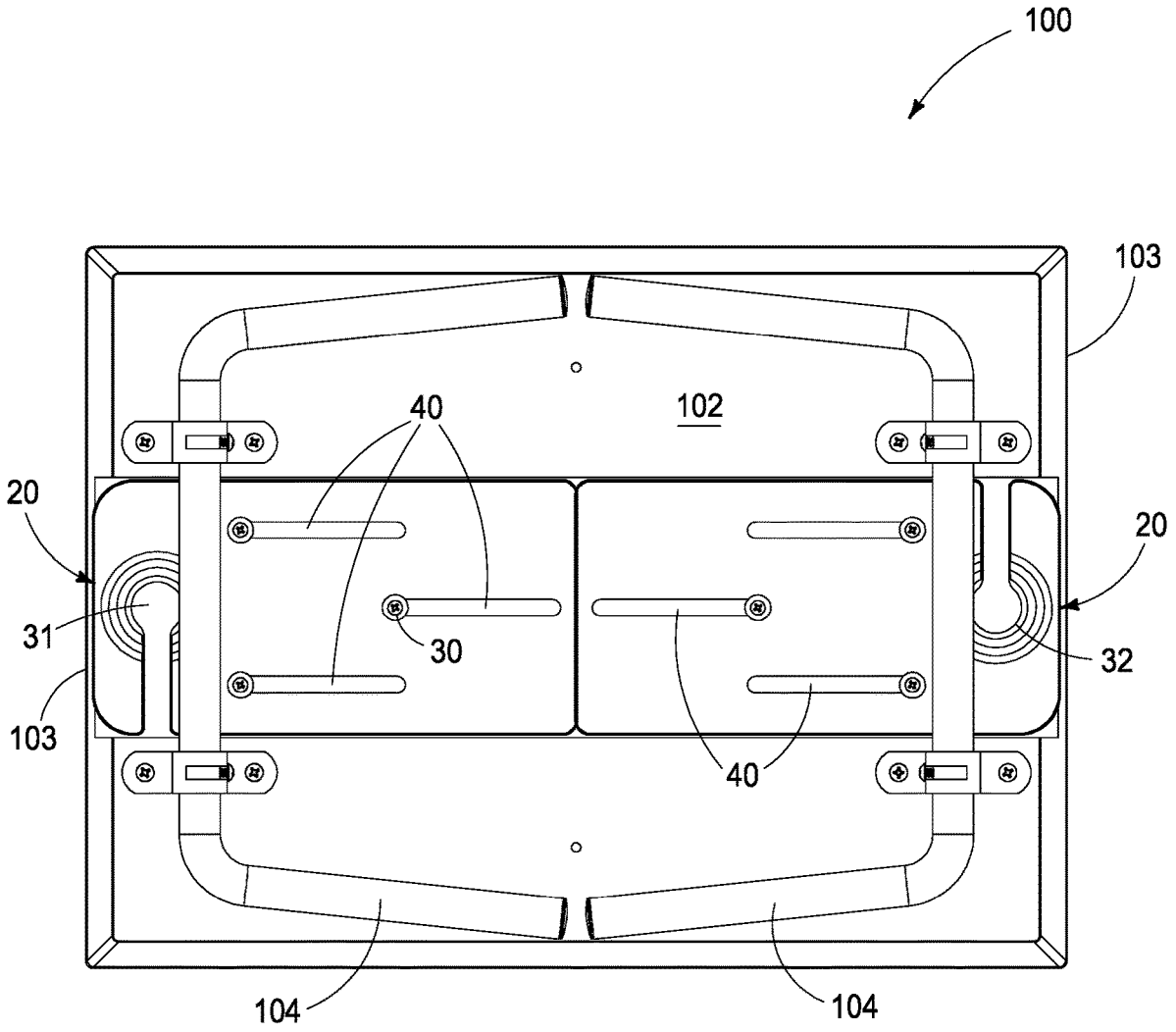
FIG. 20 is a bottom plan view thereof.
Figure 21:
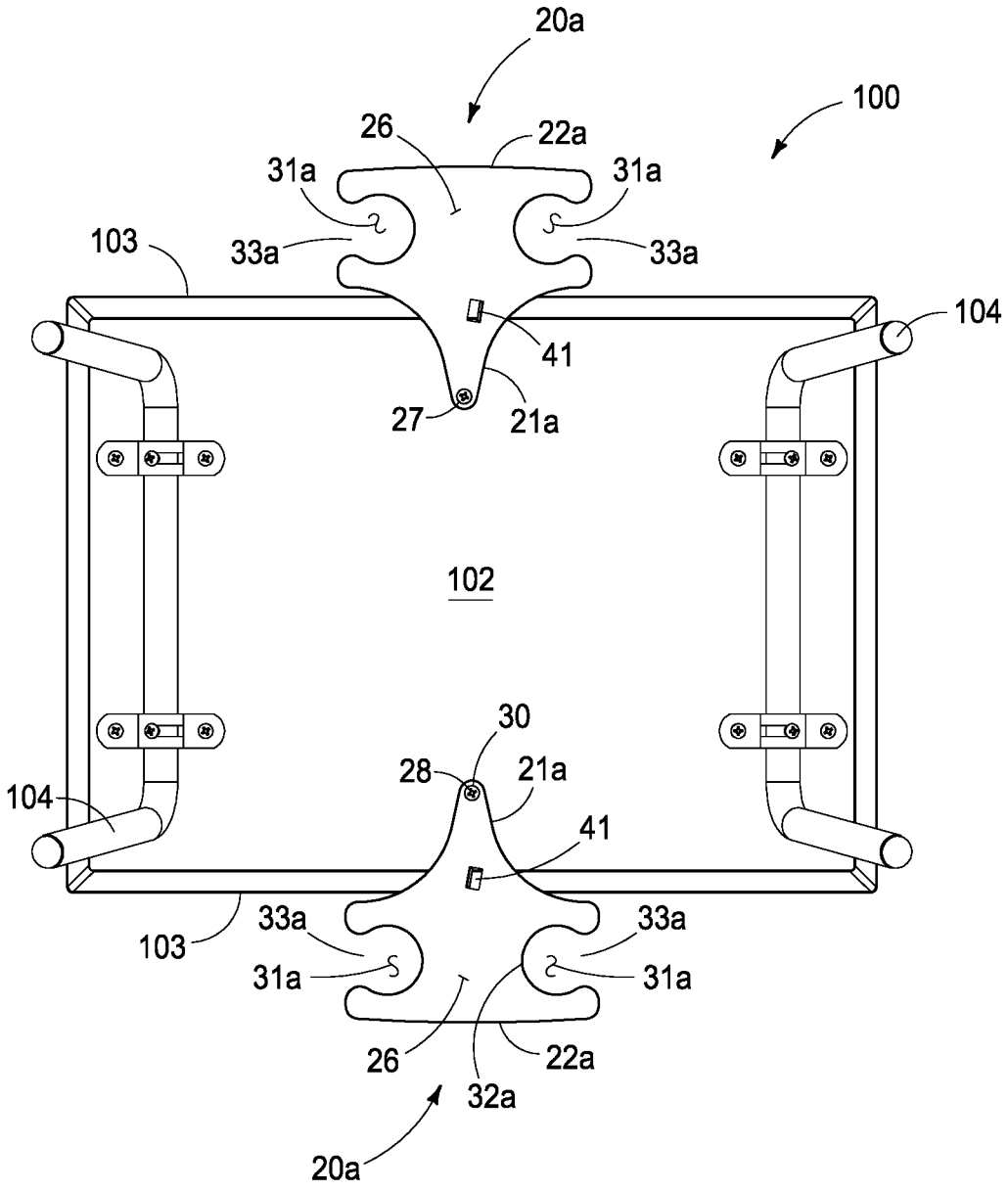
FIG. 21 is a bottom plan view of a supporting table showing a third embodiment of the off-table holder, each off-table holder configured to support plural stemmed drinking vessels and/or utensils.

The body 20 is movable, relative to the peripheral edge 103 of the supporting table 100 between a first retracted position (FIGS. 10, 20), and a second extended position (FIGS. 5, 15, 21). In the first retracted position, no portion of the body 20 extends beyond the peripheral edge 103 of the supporting table 100. In the second extended position, the second end portion 22 of the body 20 extends laterally outwardly of, and beyond, the adjacent peripheral edge 103 of the supporting table 100. A rotation limiter 41 (FIG. 5) may be carried by the body 20 to prevent over-rotation and to provide a "movement stop" wherein the rotation limiter 41 frictionally contacts the adjacent peripheral edge 103 of the supporting table 100.

The body 20 first end portion 21 defines a through hole 27. A fastener 28 that has an elongate cylindrical body, and a radially enlarged head portion 30 is carried within the through hole 27 and at least a portion of the elongate cylindrical body engages with the bottom surface 102 of the supporting table 100. The radially enlarged head portion 30 has a diameter (not shown) that is larger than a diameter (not shown) of the through hole 27 so that the radially enlarged head portion 30 may not pass axially through the through hole 27, and to movably secure the body 20 to the bottom surface 102 of the supporting table 100. The body 20 is movable relative to the fastener 20, and in at least one contemplated embodiment, the fastener 28 functions as a vertical axle. The fastener 28 may also be, without limitation, an axle, a shaft, a peg or even a threaded rod (with an engaging nut) so long as the body 20 is supported spacedly adjacent to, and generally coplanar with the bottom surface 102 of the supporting table 100 and the body 20 is movable relative thereto. The body 20 is positioned on the bottom surface 102 of the supporting table 100, relative to the peripheral edge 103 of the supporting table 100 so that when the body 20 is moved relative to the fastener 28 into the second position, the second end portion 22 of the body 20 extends outwardly of, and beyond, the adjacent peripheral edge 103.

In a first contemplated embodiment (FIGS. 1-10) the body 20 is generally planar, somewhat elongate and somewhat "wedge shaped" wherein a width dimension between the first lateral side 23 and the second lateral side 24 at the first end portion 21 is smaller than a width dimension between the first lateral side 23 and the second lateral side 24 at the second end portion 22. The second end portion 22 of the body 20 defines an open through hole 31 that has an inner circumferential edge 32 extending substantially thereabout, and the second end portion 22 of the body 20 further defines an access slot 33 that communicates between the open through hole 31, and an adjacent end/side of the body 20 so that a stem portion (not shown) of a stemware drinking vessel (not shown), or a portion of a utensil (not shown) may be passed through the access slot 33 and into the open through hole 31 so that the drinking vessel and/or utensil is supported by the body 20 and some portion of the drinking vessel (not shown) and/or utensil (not shown) may rest within or pass through the open through hole 31. Diameter (not shown) of the open through hole 31 is smaller than an exterior diameter (not shown) of the supported drinking vessel (not shown) and/or utensil so that the drinking vessel (not shown) and/or utensil cannot pass axially through the open through hole 31.

The inner circumferential edge 32 of the open through hole 31 may be beveled inwardly to form a concave depression to more securely retain a drinking vessel positioned therein. The concave depression formed by the open through hole 31 is particularly useful when the supporting table 100 is not level and/or cannot be leveled due to the underlying supporting surface.

As shown in FIG. 1, when the body 20 is in the second extended position 37, a stemmed drinking vessel and/or utensil carried within the open through hole 31 will be "off the table" so that the top surface 101 of the supporting table 100 may be used for supporting food, dishes, containers and the like. (Not shown). Further still, a stemmed drinking vessel positioned within, and supported by the open through hole 31, is less likely to be overturned or spilled by inadvertent bumps, shakes, vibrations by users moving other items supported on the top surface 101 of the supporting table 100 because the stemmed drinking vessel must be moved in a direction along the slot 33.

In a second contemplated embodiment (FIGS. 11-20), the body 20 is elongate, general planar and generally rectilinear in configuration and has a first end portion 21, a second end portion 22, a first lateral side 23, a second lateral side 24, a top portion 25 and a bottom portion 26. The open through hole 31 is defined in the body 20 spacedly adjacent the second end portion 22 and the open through hole 31 has an inner circumferential edge 32 extending thereabout. A slot 33 communicates between the open through hole 31 and the first lateral side 23 of the body 20.

Figure 11:
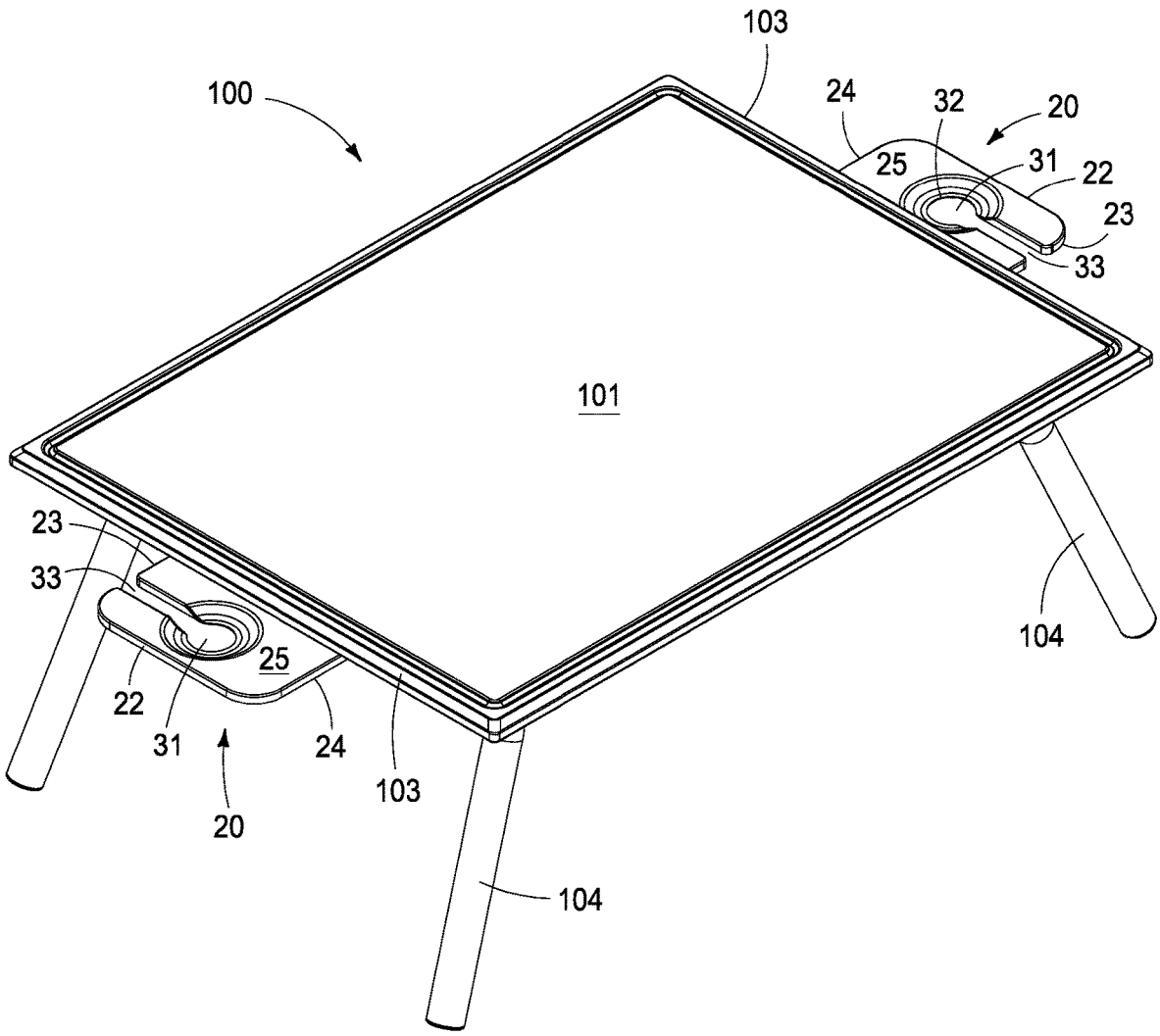
FIG. 11 is a perspective top, end and lateral side view of a supporting table, with supporting legs extended, showing a second embodiment of the holder for a stemmed drinking vessel and/or utensil in a second position and extending outwardly from under both end portions of the supporting table.
Figure 12:
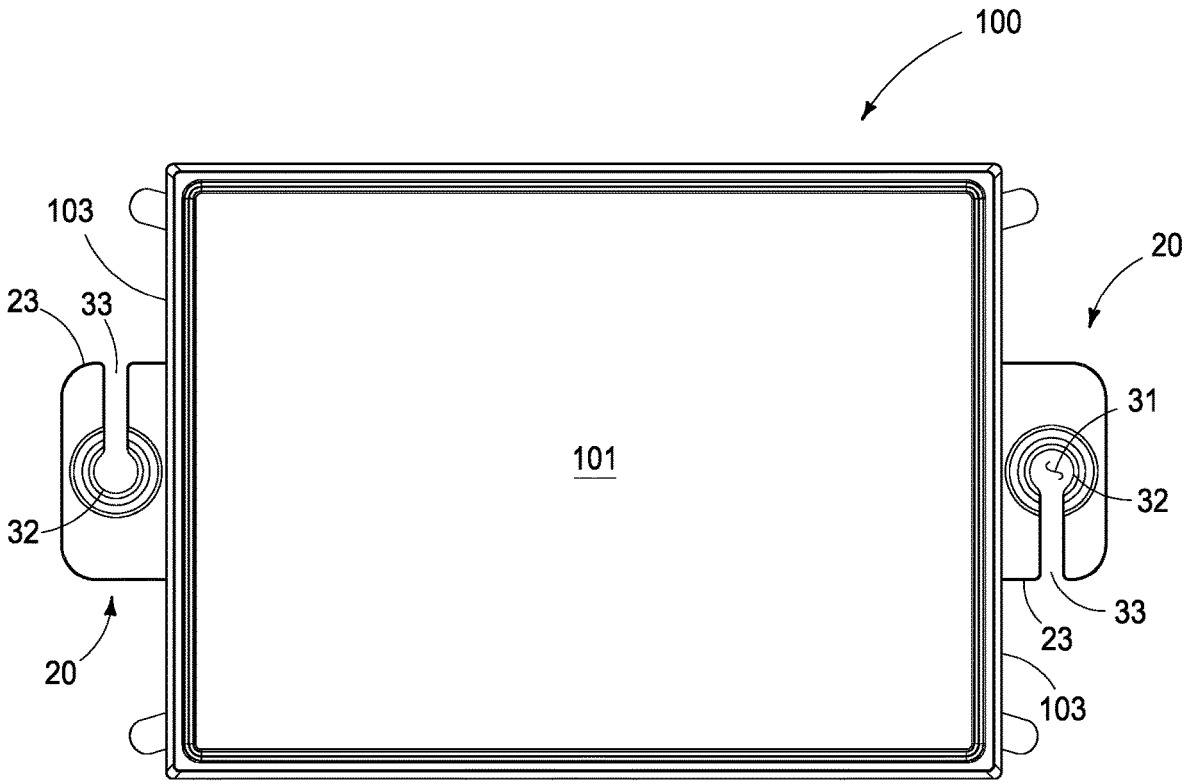
FIG. 12 is a top plan view thereof.
Figure 13:
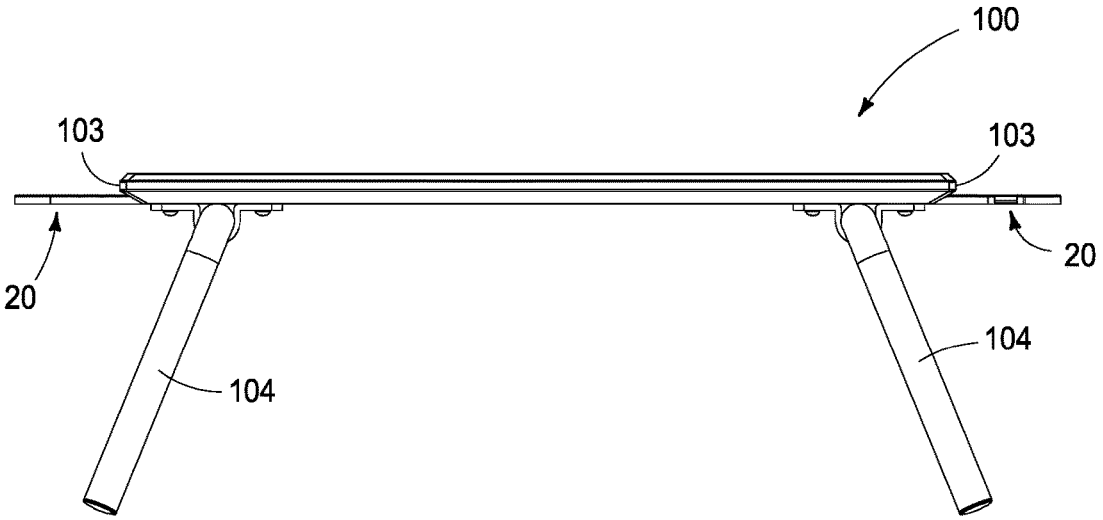
FIG. 13 is an orthographic lateral side view thereof, both lateral sides being the same.
Figure 14:
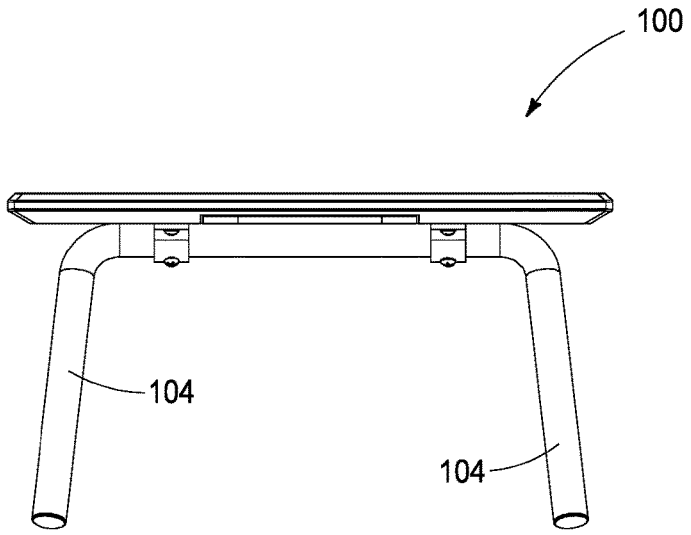
FIG. 14 is an orthographic end view thereof, both ends being the same.

As shown in FIG. 15, in the second contemplated embodiment, plural, spacedly arrayed and parallel, elongated through slots 40 are defined in the body 20 proximate the first end portion 21 and proximate a medial portion. A fastener 28 having a radially enlarged head portion 30 extends axially through each of the elongated through slots 40. The fasteners 28 secure the body 20 to the bottom surface 102 of the supporting table 100. The fasteners 28 extending axially through the elongated through slots 40 allow the body 20 to slidably move relative to the peripheral edge 103 of the supporting table 100 between a first retracted position (FIGS. 16-20) and a second extended position (FIGS. 11-15). As shown in FIG. 11, when the body 20 is in the second extended position, a drinking vessel and/or utensil carried within the open through hole 31 is "off the table" so that the top surface 101 of the supporting table 100 may be used for supporting food, plates, containers and the like. (not shown). The concave configuration of the inner circumferential edge 32 of the open through hole 31 on the top 25 enhances frictional positional engagement between the body 20 and the stemmed drinking vessel to prevent inadvertent disengagement of the stemmed drinking vessel from the open through hole 31.

It is further contemplated that plural, spacedly arrayed, open through holes 31 may be defined in the body 20 to support plural drinking vessels and/or plural utensils. (See FIG. 21). In such a third contemplated embodiment, two spacedly adjacent open through holes 31*a* are defined in the second end portion 22*a* of the body 20*a*, and each of the plural open through holes 31*a* defines an access slot 33*a* through which a portion of a stem of a stemmed drinking vessel (not shown) may pass, so that the drinking vessel (not shown) may be positionally supported by the body 20 and at least partially within the open through hole 31*a*.

Although the Figures show the first embodiment (FIGS. 1-10) of the instant invention carried by the supporting table 100 spacedly adjacent the first and second lateral sides 23, 24 respectively, and further show the second embodiment (FIGS. 11-20) of the instant invention carried by the supporting table 100 spacedly adjacent the first and second end portions 21, 22 respectively, such positions are not limiting and the embodiments may be positioned at either or both the lateral sides 23, 24 and/or either or both of the end portions 21, 22.

OPERATION

Having described the structure of my holder for a stemmed drinking vessel and/or utensil, its operation is briefly described as follows:

If the supporting table 100 has collapsible supporting legs 104, the supporting table 100 is oriented so that its supporting legs 104 are accessible by the user. The supporting legs 104 are manipulated from a first storage position (FIGS. 10, 20) to a second extended position (FIGS. 1, 11) so that the supporting table 100, when resting upon the supporting legs 104 is spacedly above the underlying supporting surface, which may be, but is not limited to, the ground surface. If a different type of supporting table 100 is used, the different type of supporting table 100 is deployed so that the top and bottom surfaces 101, 102 respectively, thereof, are both spacedly above the underlying supporting ground surface. (e.g. legs are attached, or support post is inserted into the underlying supporting surface, etc.).

If the first (or third) embodiment (FIGS. 1-10, 21) of the instant invention is installed on the bottom surface 102 of the supporting table 100, the user grasps the body 20 and rotates the body 20 about the fastener 28, so that the second end portion 22 of the body 20 extends outwardly from the peripheral edge 103 of the supporting table 100, and the top 25 of the body 20 is coplanar with the bottom surface 102 of the supporting table 100. If the body 20 has a rotation limiter 41 (FIG. 5), the body 20 may be rotated about the fastener 28 until the rotation limiter 41 frictionally contacts the adjacent peripheral edge 103 of the supporting table 100 and any further rotation of the body 20 about the fastener 28 is prevented. When the second end portion 22 of the body 20 is outward of the peripheral edge 103, the open through hole 31 defined in the second end portion 22, and the access slot 33 is accessible by the user. The user may then pass a stem portion of a drinking vessel (not shown), such as, but not limited to a wine glass or champagne flute (not shown) through the access slot 33, and thereafter rest the drinking vessel within the open through hole 31 wherein the drinking vessel frictionally rests, at least in part upon, the inner circumferential edge 32 of the open through hole 31. Similarly, if a utensil (not shown) such as, but not limited to serving tongs or other utensil is to be supported by the body 20, a portion of the utensil, which may be, but is not limited to a shank, or handle, or shaft, or loop may be passed through the access slot 33 so that the utensil is supported by the body 20 and off the table 100 and off the underlying supporting surface.

If the second contemplated embodiment (FIGS. 11-20) of the instant invention is carried by the supporting table 100, the user grasps the body 20 and draws the body 20 laterally outwardly relative to the peripheral edge 103 of the supporting table 100 so that the body 20 slides along the plural fasteners 28 positioned within the plural parallel elongated through slots 40, so that the second end portion 22 of the body 20 extends outwardly from the peripheral edge 103 of the supporting table 100. When the second end portion 22 of the body 20 is outward of the peripheral edge 103, the open through hole 31 defined in the second end portion 22 is accessible by the user. The user may then pass a stem a portion of a drinking vessel (not shown), such as, but not limited to a wine glass or champagne flute (not shown) through the access slot 33, and thereafter rest the stemware drinking vessel within the open through hole 31. Similarly, if a utensil (not shown) such as, but not limited to serving tongs or other utensil is to be supported by the body 20, a portion of the utensil, which may be, but is not limited to a shank, or handle, or shaft, or loop may be passed through the access slot 33 so that the utensil is supported by the body 20 and off the table 100 and off the underlying supporting surface.

A principal object of the present invention is an off table holder for a stemmed drinking vessel and/or utensil that is movably secured to a bottom surface of a supporting table, the holder comprising: a body having a first end portion, a spaced apart second end portion, a first lateral side, a second lateral side, a top and a bottom; a through hole defined in the body spacedly adjacent the first end portion for a fastener that has a cylindrical body and a radially enlarged head portion at one end of the cylindrical body, and the cylindrical body extends axially through the through hole defined in the body spacedly adjacent the first end portion and engages with the bottom surface of the supporting table spacedly adjacent inwardly a peripheral edge of the supporting table, and the radially enlarged head portion has a diameter that will not pass axially through the through hole; an open through hole defined in the body spacedly adjacent the second end portion; and the body is movable between a first position and a second position relative to the peripheral edge of the supporting table and relative to the fastener extending through the through hole defined in the first end portion of the body.

A further object of the present invention is a holder wherein the body is tapered so that a width dimension of the first end portion is smaller than a width dimension of the second end portion.

A further object of the present invention is a holder wherein the body is rectilinear.

A further object of the present invention is a holder wherein the fastener extending through the through hole defined in the first end portion is a vertical axle, and the body rotates thereabout between the first retracted position and the second extended position.

A further object of the present invention is a holder further comprising: plural spacedly arrayed through holes defined in the first end portion of the body, and each of the plural through hole is an elongated hole, and each of the elongated holes is parallel to the other of the plural elongated holes; and a fastener extends through each of the plural elongated holes; and the body slidably moves relative to the peripheral edge of the supporting table along the plural fasteners extending through the plural elongated holes.

A still further object of the present invention is a holder further comprising: plural spaced apart open through holes defined in the second end portion of the body.

A still further object of the present invention is an off table holder for a stemmed drinking vessel and/or utensil that is movably secured to a bottom surface of a supporting table, the holder comprising: a body having a first end portion, a spaced apart second end portion, a first lateral side, a second lateral side, a top and a bottom, and wherein the body is tapered so that a width dimension of the first end portion is different from a width dimension of the second end portion; a through hole defined in the body spacedly adjacent the first end portion for a fastener that has a cylindrical body and a radially enlarged head portion at one end of the cylindrical body, and the cylindrical body extends axially through the through hole defined in the body spacedly adjacent the first end portion and engages with the bottom surface of the supporting table, spacedly adjacent inwardly a peripheral edge of the supporting table, and the radially enlarged head portion has a diameter that will not pass axially through the through hole, and wherein the body moves relative to the fastener between the first retracted position and the second extended position; an open through hole defined in the body spacedly adjacent the second end portion; and the body is movable between a first position and a second position relative to the peripheral edge of the supporting table and relative to the fastener extending through the through hole defined in the first end portion of the body.

A still further object of the present invention is a holder further comprising: plural spacedly arrayed through holes defined in the first end portion of the body, and each of the plural through hole is an elongated hole, and each of the elongated holes is parallel to the other of the plural elongated holes; and a fastener extends through each of the plural elongated holes; and the body slidably moves relative to the peripheral edge of the supporting table along the plural fasteners extending through the plural elongated holes.

A still further object of the present invention is a holder further comprising: plural spaced apart open through holes defined in the second end portion of the body.

An even still further object of the present invention is a holder wherein an inner circumferential edge of the open through hole is beveled inwardly to form a concave depression in the top of the body and about the open through hole.

Having described the structure and operation of my off table holder for a stemmed drinking vessel and/or utensil, I file this US Utility Patent Application and request issuance of utility letters patent.

I claim:

1. An off table holder for a stemmed drinking vessel that is movably secured to a bottom surface of a supporting table, the off table holder comprising:

a body having a first end portion, a spaced apart second end portion, a first lateral side, a second lateral side, a top and a bottom;

a through hole defined in the body spacedly adjacent the first end portion for a fastener that has a cylindrical body and a radially enlarged head portion at one end of the cylindrical body, and the cylindrical body extends axially through the through hole defined in the body spacedly adjacent the first end portion and engages with the bottom surface of the supporting table, spacedly adjacent inwardly a peripheral edge of the supporting table, and the radially enlarged head portion has a diameter that will not pass axially through the through hole;

an open through hole defined in the body spacedly adjacent the second end portion; and the body is fastened directly to the bottom surface of the supporting table and the body is movable between a first position and a second position relative to the peripheral edge of the supporting table and relative to the fastener extending through the through hole defined in the first end portion of the body.

2. The holder as claimed in claim 1 and wherein the body is tapered so that a width dimension of the first end portion is smaller than a width dimension of the second end portion.

3. The holder as claimed in claim 1 and wherein the body is rectilinear.

4. The holder as claimed in claim 1 and wherein the fastener extending through the through hole defined in the first end portion is a vertical axle, and the body rotates thereabout between the first retracted position and the second extended position.

5. The holder as claimed in claim 1 and further comprising:

plural spacedly arrayed through holes defined in the first end portion of the body, and each of the plural through hole is an elongated hole, and each of the elongated holes is parallel to the other of the plural elongated holes; and a fastener extends through each of the plural elongated holes; and the body slidably moves relative to the peripheral edge of the supporting table along the plural fasteners extending through the plural elongated holes.

6. The holder as claimed in claim 1 and further comprising:

plural spaced apart open through holes defined in the second end portion of the body.

7. An off table holder for a stemmed drinking vessel that is movably secured to a bottom surface of a supporting table, the off table holder comprising:

a body having a first end portion, a spaced apart second end portion, a first lateral side, a second lateral side, a top and a bottom, and wherein the body is tapered so that a width dimension of the first end portion is different from a width dimension of the second end portion;

a through hole defined in the body spacedly adjacent the first end portion for a fastener that has a cylindrical body and a radially enlarged head portion at one end of the cylindrical body, and the cylindrical body extends axially through the through hole defined in the body spacedly adjacent the first end portion and engages with the bottom surface of the supporting table, spacedly adjacent inwardly a peripheral edge of the supporting table, and the radially enlarged head portion has a diameter that will not pass axially through the through hole, and wherein the body moves relative to the fastener between the first retracted position and the second extended position an open through hole defined in the body spacedly adjacent the second end portion; and the body is fastened directly to the bottom surface of the supporting table and the body is movable between a first position and a second position relative to the peripheral edge of the supporting table and relative to the fastener extending through the through hole defined in the first end portion of the body.

8. The holder as claimed in claim 7 and further comprising:

plural spacedly arrayed through holes defined in the first end portion of the body, and each of the plural through hole is an elongated hole, and each of the elongated holes is parallel to the other of the plural elongated holes; and a fastener extends through each of the plural elongated holes; and the body slidably moves relative to the peripheral edge of the supporting table along the plural fasteners extending through the plural elongated holes.

9. The holder as claimed in claim 7 and further comprising:

plural spaced apart open through holes defined in the second end portion of the body.

10. The holder as claimed in claim 1 and wherein an inner circumferential edge of the open through hole is beveled inwardly to form a concave depression in the top of the body and about the open through hole.

11. The holder as claimed in claim 7 and wherein an inner circumferential edge of the open through hole is beveled inwardly to form a concave depression in the top of the body and about the open through hole.

* * * * *